US010584844B1

(12) United States Patent
Parrillo

(10) Patent No.: US 10,584,844 B1
(45) Date of Patent: Mar. 10, 2020

(54) ADJUSTABLE LAMP SHADE

(71) Applicant: Patricia A. Parrillo, New Port Richey, FL (US)

(72) Inventor: Patricia A. Parrillo, New Port Richey, FL (US)

( * ) Notice: Subject to any disclaimer, the term of this patent is extended or adjusted under 35 U.S.C. 154(b) by 0 days.

(21) Appl. No.: 16/003,958

(22) Filed: Jun. 8, 2018

Related U.S. Application Data

(60) Provisional application No. 62/517,283, filed on Jun. 9, 2017.

(51) Int. Cl.

| | |
|---|---|
| ***F21V 1/08*** | (2006.01) |
| ***F21V 11/04*** | (2006.01) |
| ***F21W 131/30*** | (2006.01) |
| ***F21S 6/00*** | (2006.01) |

(52) U.S. Cl.
CPC ..... *F21V 1/08* (2013.01); *F21V 11/04* (2013.01); *F21S 6/002* (2013.01); *F21W 2131/3005* (2013.01)

(58) Field of Classification Search
CPC .... F21V 1/08; F21V 1/04; F21S 6/002; E06B 9/26; E06B 9/264
USPC ..... 362/321, 283
See application file for complete search history.

(56) References Cited

U.S. PATENT DOCUMENTS

| | | | | |
|---|---|---|---|---|
| 479,207 | A | 7/1892 | Edmond et al. | |
| 1,509,744 | A | 9/1924 | Wilson | |
| 2,437,825 | A | 3/1948 | Kohn | |
| 2,997,576 | A | 1/1960 | Heitshu | |
| 3,115,310 | A | 12/1963 | Hofman | |
| 4,735,251 | A * | 4/1988 | Tsuchida | A01G 9/222 160/172 R |
| 4,800,473 | A | 1/1989 | Tremblay | |
| 5,165,787 | A * | 11/1992 | Holzhacker | F21V 1/00 362/283 |
| 5,276,601 | A | 1/1994 | Holzhacker | |
| 5,733,036 | A | 3/1998 | Montgomery | |
| 7,124,803 | B2 * | 10/2006 | Jin | E06B 9/264 160/107 |
| 2010/0259915 | A1 * | 10/2010 | Hubbs | F21S 8/033 362/20 |
| 2012/0087131 | A1 * | 4/2012 | Rota Jovani | F21S 6/004 362/279 |
| 2016/0178164 | A1 * | 6/2016 | Nishida | E06B 9/303 359/596 |

* cited by examiner

*Primary Examiner* — William N Harris
(74) *Attorney, Agent, or Firm* — Cramer Patent & Design, PLLC; Aaron R. Cramer

(57) ABSTRACT

An adjustable lamp shade includes at least one (1) section that has an array of horizontal louvers located on a side thereof. Each respective array of louvers is controlled by an actuating mechanism.

18 Claims, 9 Drawing Sheets

ADJUSTABLE LAMP SHADE

RELATED APPLICATIONS

The present invention was first described in and claims the benefit of U.S. Provisional Application No. 62/517,283, filed Jun. 9, 2017, the entire disclosures of which are incorporated herein by reference.

FIELD OF THE INVENTION

The present invention relates generally to the field of an adjustable lamp shade.

BACKGROUND OF THE INVENTION

A great many of us enjoy curling up with a good book at night in bed prior to falling asleep. The reading of a book just seems to put our minds at ease and makes for a good night's rest. A small table lamp positioned on an adjacent nightstand is used as a light source by many. Unfortunately, the light levels produced by such lamps are often inadequate for reading, especially when direct light rays from the lamp light bulb are blocked the lamp shade. Many people are then forced to move the lamp, perhaps tilt the shade, or even remove it completely in some cases. However, this practice may also cause the light to shine in the faces of sleeping partners who are trying to sleep immediately adjacent to the reader.

Since the earliest days of interior lighting, people have been utilizing lamp shades to adjust and direct a given flow of non-natural light. Similarly, people have also been using curtains, shades and blinds to adjust and direct a given flow of natural light. All these methods, regardless of the source of light have the common purpose of enabling the adjustment of a given light source to suit the purpose of the user, with some being more adjustable than others.

While curtains, shades and blinds may be regarded as highly adjustable with respect to the amount of light permitted through a particular window, a lamp shade is typically non-adjustable and static. Therefore, a need exists for a lamp shade that permits a level of adjustability commonly associated with the aforementioned window dressings. Such a means can also control light direction and reduce adjacent light spillage in a manner that address these shortcomings. The development of the adjustable light louver for lamp shade fulfills this need.

Some efforts to address this issue have been made in the form of U.S. Pat. Nos. 2,437,825, 1,509,744 and U.S. Pat. App. Pub. No. 2012/0087131. However, these solutions are not satisfactory. Therefore, there is a need for an adjustable lamp shade that effectively manipulates the flow of light in a manner that is both efficient and easy to operate without sacrificing aesthetic appeal. The present invention fulfills this need.

SUMMARY OF THE INVENTION

In view of the foregoing references, the inventor recognized the aforementioned inherent problems and observed that there is a need for a lamp shade that includes at least one (1) side having an adjustable louver assembly. The remaining sides of the lamp shade would preferably be a shade panel. In certain embodiments, the overall invention is merely the lamp shade and in other embodiments, the overall invention includes the lamp shade, a base, mounting hardware, and an illuminating device. An actuating mechanism is capable of manipulating a respective louver assembly to open and close in an incremental rotational path, thereby selectively adjusting for the amount of light that is generated by the illuminating device therethrough.

To achieve the above objectives, it is an object of the present invention to provide such a lamp shade having at least one (1) louver assembly including a frame, a plurality of horizontally-disposed slats each supported in opposing sides of the frame and capable of free rotation respective to the frame, and the actuating mechanism attached to the bottom of the frame. When the actuating mechanism rotates in a first direction, the plurality of slats rotate in the first direction. When the actuating mechanism rotates in a second direction, the plurality of slats rotate in the second direction. It is preferred that the slats rotate synchronously.

In certain embodiments, the actuating mechanism includes an upper shaft attached to and freely rotating relative to the frame, a drive axle having a first end attached to and freely rotating relative to the frame, an adjustment knob in mechanical communication with a second end of the drive axle, and at least one (1) coupling element, each having a first end attached to an in mechanical communication with the upper shaft and a second end attached to and in mechanical communication with the drive axle. Each coupling element is also attached to each of the plurality of slats. Actuating of the adjustment knob therefore rotates the drive shaft, coupling elements, and the plurality of slats.

In certain embodiments, the adjustment knob is in mechanical communication with the drive axle second end via a ninety degree (90°) bevel gear assembly.

In certain embodiments, the first and second ends of the coupling elements are attached to the respective upper shaft and drive axle with idler pulleys. In other embodiments, the coupling elements are a braided ladder cord.

It is a further object to provide for different geometries of the shape of the lamp shade itself. In a preferred embodiment, the shape is generally a truncated pyramid. In other embodiments, the shape is generally cuboidal. Preferably, the amount of louver assemblies is two (2), where the louver assemblies are located at opposing sides from each other.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
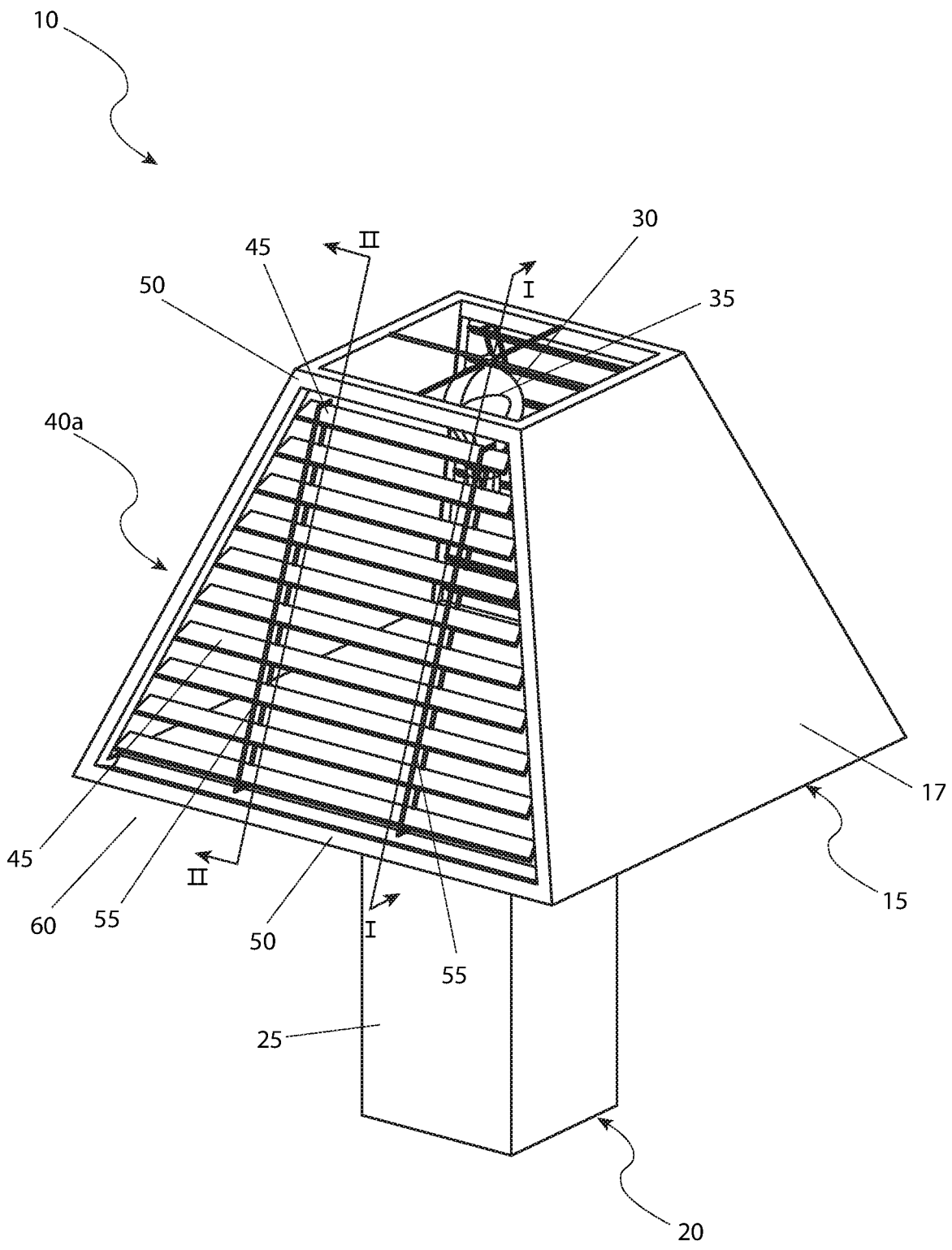
FIG. 1 is a perspective view of the adjustable light louver 10, according to the preferred embodiment of the present invention.

10 adjustable light louver
11 alternate adjustable light louver
15 shade assembly
16 alternate shade assembly
17 shade panel
18 alternate shade panel
20 lamp
25 base structure
30 supporting harp
35 illumination lamp
40*a* louvered surface
40*b* alternate louvered surface
45 slats
50 frame
55 braided ladder cords
60 slat angle adjustment knob
65 idler pulleys
70 upper shaft
75 drive pulleys
80 drive axle
85 ninety degree (90°) bevel gear assembly
90 perpendicular shaft
95 angle "a"
100 entering light rays
105 exiting light rays
110 angle "b"
115 angle "c"
120 angle "d"
125 bedside horizontal surface
130 first user
135 second user
140 bed
145 reading object

DETAILED DESCRIPTION OF THE PREFERRED EMBODIMENT

The best mode for carrying out the invention is presented in terms of its preferred embodiment, herein depicted within FIGS. 1-4, and alternately within FIGS. 6-9. However, the invention is not limited to the described embodiment, and a person skilled in the art will appreciate that many other embodiments of the invention are possible without deviating from the basic concept of the invention and that any such work around will also fall under the scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Referring now to FIG. 1, a perspective view of adjustable light louver for lamp shade 10, according to the preferred embodiment of the present invention is disclosed. The adjustable light louver for lamp shade 10 (herein described as the "device") 10, includes a generally pyramidal shade assembly 15 with a truncated top that is placed atop a conventional table lamp 20. The table lamp 20 is envisioned to include a base structure 25 along with a supporting harp 30 and an illumination lamp 35. The device 10 is envisioned to work with all types of illumination lamp 35 including but not limited to: fluorescent, incandescent, light-emitting diode (LED), high intensity discharge (HID) or the like. A louvered surface 40*a* is provided on at least one (1) exterior surface of the shade assembly 15. The louvered surface 40*a* allows for the application of direct light rays from the illumination lamp 35 without passing through the shade assembly 15. Thus, depending on the illumination requirements, ambient conditions, task duration, and the like, the user would procure a shade assembly 15 with the necessary quantity of louvered surface 40*a* in the correct orientation. The remaining exterior surfaces of the shade assembly comprise a shade panel 17, which may be opaque, translucent, or transparent. Preferably, the shade panels 17 are opaque so as to restrict as much as possible the direct light rays from the illumination lamp 35.

The louvered surface 40*a* includes multiple slats 45 within a frame 50. The slats 45 are held in place with at least one (1) braided ladder cord 55. The braided ladder cords 55 not only provides for securement of the slats 45 but allows for their movement along a plane parallel with the plane of the frame 50 where the slats 45 are attached to a nearly inverted placement of one hundred eighty degrees (180°). This movement is controlled by a slat angle adjustment knob 60 located near the bottom of the frame 50. The components and operation allow for the slats 45 to be angularly adjusted but not moved up and down as a group as is the case with conventional horizontal window blinds.

Figure 2:
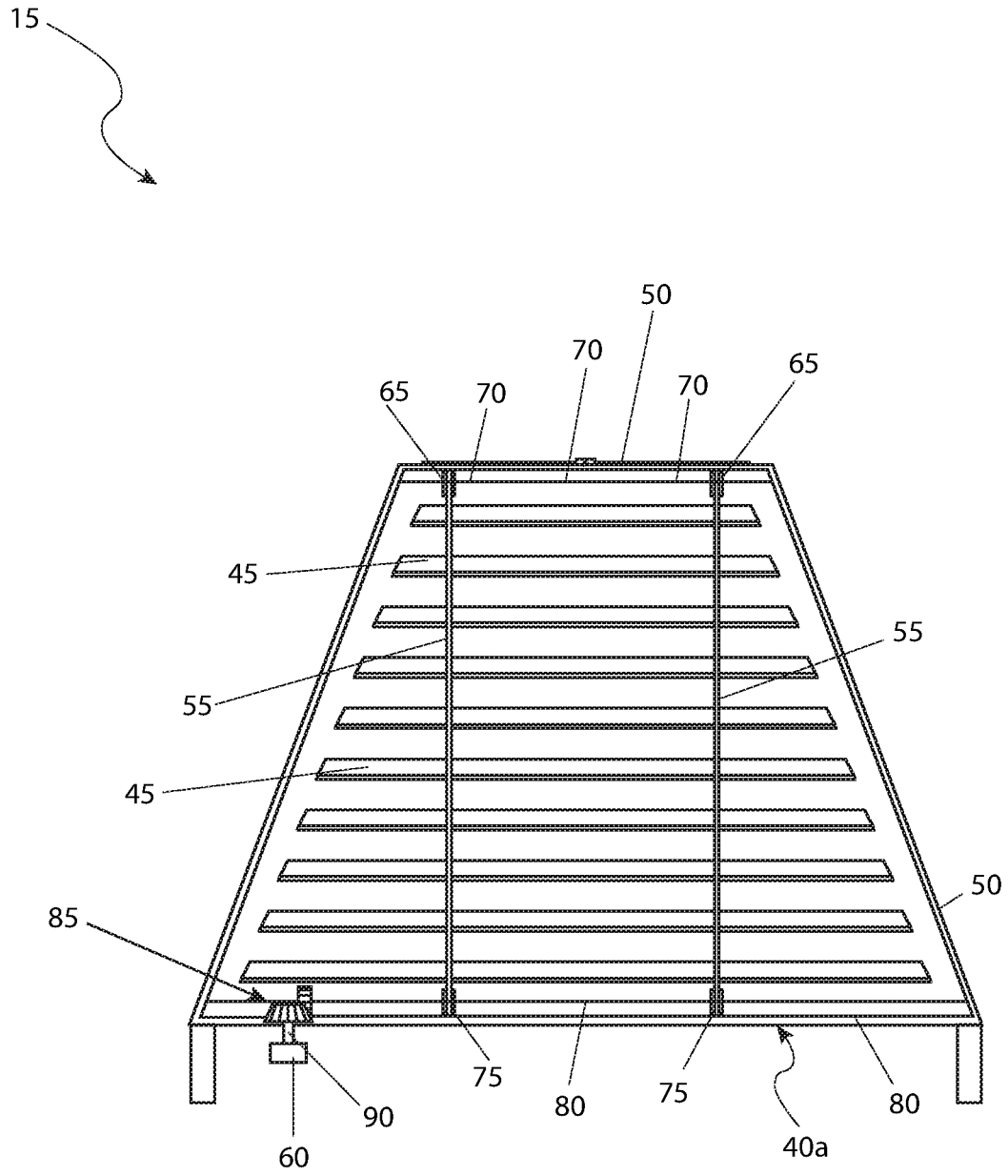
FIG. 2 is a sectional view of the adjustable light louver 10, as seen along a line I-I, as shown in FIG. 1, according to the preferred embodiment of the present invention.

Referring next to FIG. 2, a sectional view of the device 10, as seen along a line I-I, as shown in FIG. 1, according to the preferred embodiment of the present invention is depicted. As aforementioned described, the slats 45 are provided within the frame 50 and are held in place via the braided ladder cords 55. The braided ladder cords 55 are secured at the top by two (2) idler pulleys 65 on an upper shaft 70. In a similar manner, the braided ladder cords 55 are secured at the bottom by two (2) drive pulleys 75 on a drive axle 80. Both ends of the upper shaft 70 terminate in the frame 50 where they can rotate freely. One (1) end of the drive axle 80 terminates in a similar manner in the frame 50 (i.e., freely rotating) while the opposite end terminates in a ninety degree (90°) bevel gear assembly 85. The ninety degree (90°) bevel gear assembly 85 is of standard design and is envisioned to be made of plastic due to the low rotational forces envisioned. A perpendicular shaft 90 then interconnects the slat angle adjustment knob 60 to the ninety degree (90°) bevel gear assembly 85. The tension on the braided ladder cords 55 is provided by the spacing and associated physical structure of the idler pulleys 65, the upper shaft 70, the drive pulleys 75 and the drive axle 80. Should any misalignment occur between both braided ladder cords 55 due to wear and tear, or abusive use, a simple turn of the slat angle adjustment knob 60 in either direction, forcing slippage on one (1) connected set of idler pulleys 65 and drive pulleys 75 will result in return of alignment and allow for continued synchronized usage. The slats 45 and the frame 50 could be constructed from a wide variety of material such as wood, plastic, metal, or the like. The use of one (1) specific material in any or all components should not be limiting factor of the present invention.

Figure 3:
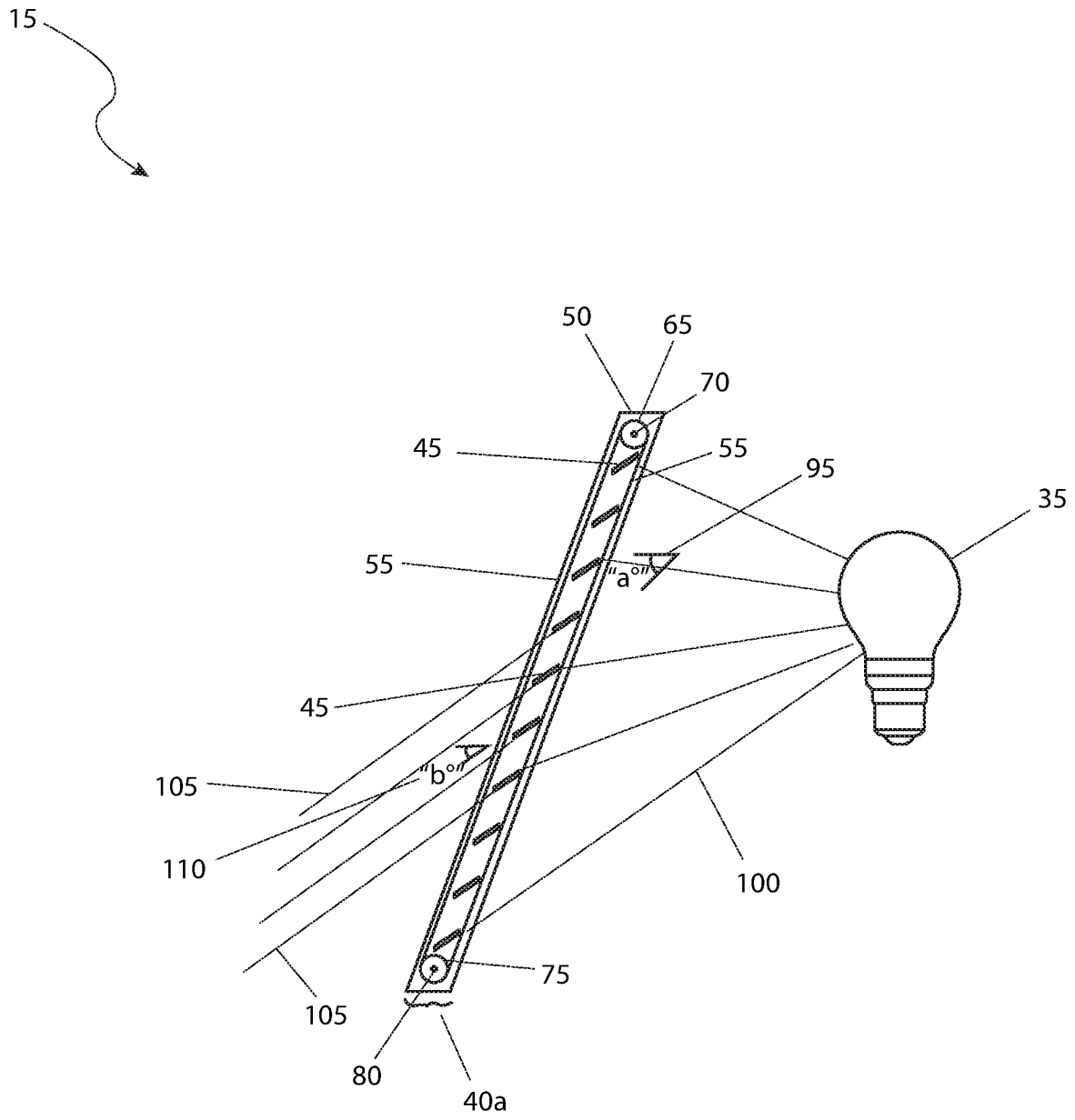
FIG. 3 is a sectional view of the adjustable light louver 10, shown in a partially closed state, as seen along a line II-II, as shown in FIG. 1, according to the preferred embodiment of the present invention.

Referring now to FIG. 3, a sectional view of the device 10, shown in a partially closed state, as seen along a line II-II, as shown in FIG. 1, according to the preferred embodiment of the present invention is shown. The slats 45 are supported by the braided ladder cords 55 as shown. Likewise, the braided ladder cords 55 are bound by the idler pulleys 65 at the top and the drive pulleys 75 at the bottom. The idler pulleys 65 are mounted upon the upper shaft 70 while the drive pulleys 75 are mounted upon the drive axle 80. As shown, the slats 45 produce an angle "a" 95 with respect to a horizontal line. As such, entering light rays 100 are somewhat restricted from passing through the louvered surface 40*a*. As a result of light reflection upon the various slats 45, exiting light rays 105 are only permitted at an angle "b" 110. As such, the exiting light rays 105 can only travel a short distance in a room or space in which the device 10 is utilized before striking a surface and being absorbed with only minor reflectance. Further detail on utilization of the device 10 in a typical room environment will be provided herein below.

Figure 4:
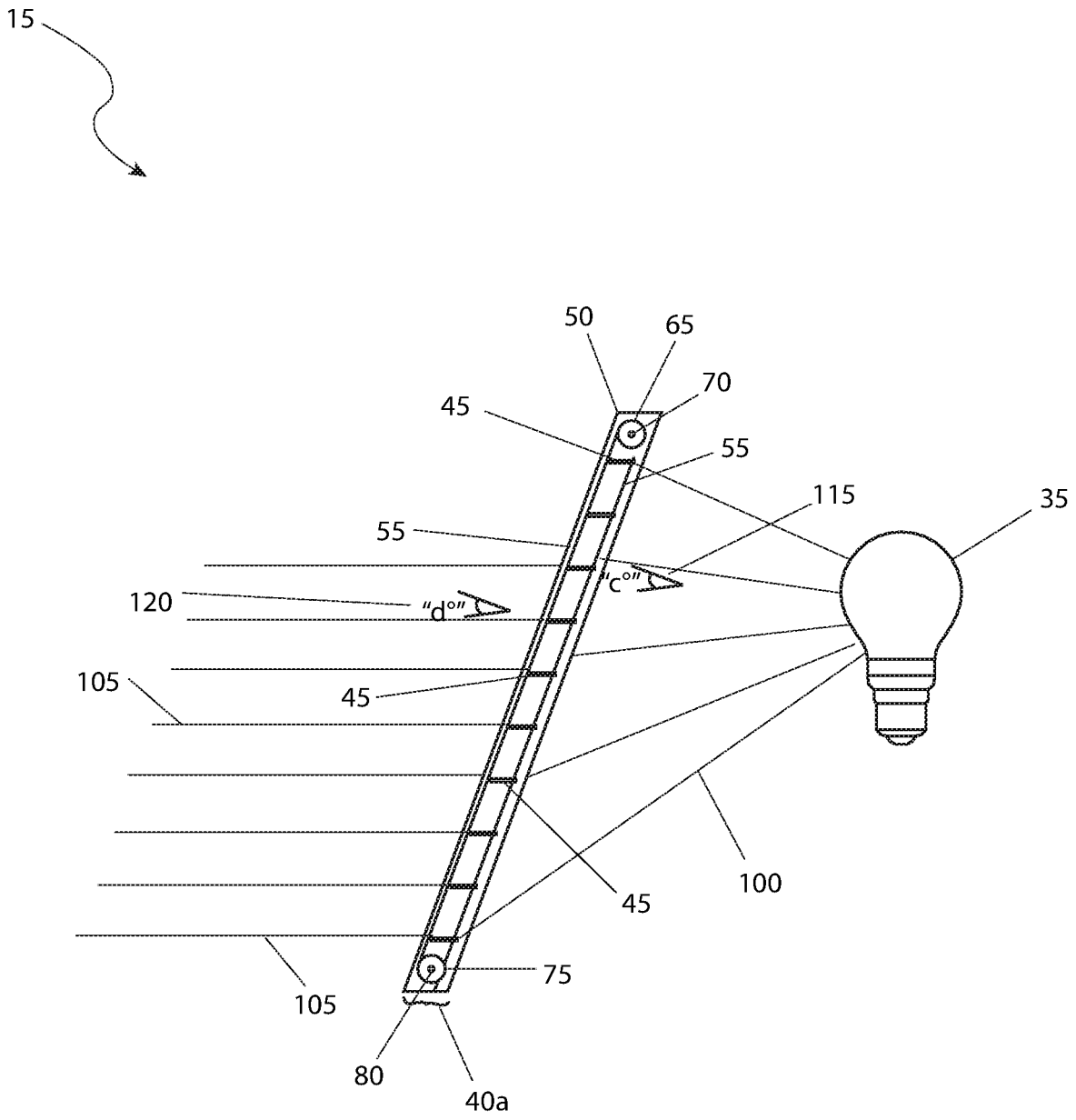
FIG. 4 is a sectional view of the adjustable light louver 10, shown in a mostly open state, as also seen along a line II-II, as shown in FIG. 1, according to the preferred embodiment of the present invention.

Referring next to FIG. 4, a sectional view of the device 10, shown in a mostly open state, as also seen along a line II-II, as shown in FIG. 1, according to the preferred embodiment of the present invention is disclosed. As before, the slats 45 are supported by the braided ladder cords 55 as shown. Likewise, the braided ladder cords 55 are bound by the idler pulleys 65 at the top and the drive pulleys 75 at the bottom. The idler pulleys 65 are mounted upon the upper shaft 70 while the drive pulleys 75 are mounted upon the drive axle 80. As shown, the slats 45 produce an angle "c" 115 with respect to a horizontal line. As such, entering light rays 100 are barely impeded from passing through the louvered surface 40. As a result, the exiting light rays 105, are not restricted and pass through at an angle "d" 120. As such, the exiting light rays 105 are free to travel in a room or space in which the device 10 is utilized, with almost as little restriction if the device 10 was not present at all. Further detail on utilization of the device 10 in a typical room environment will be provided herein below.

Figure 5:
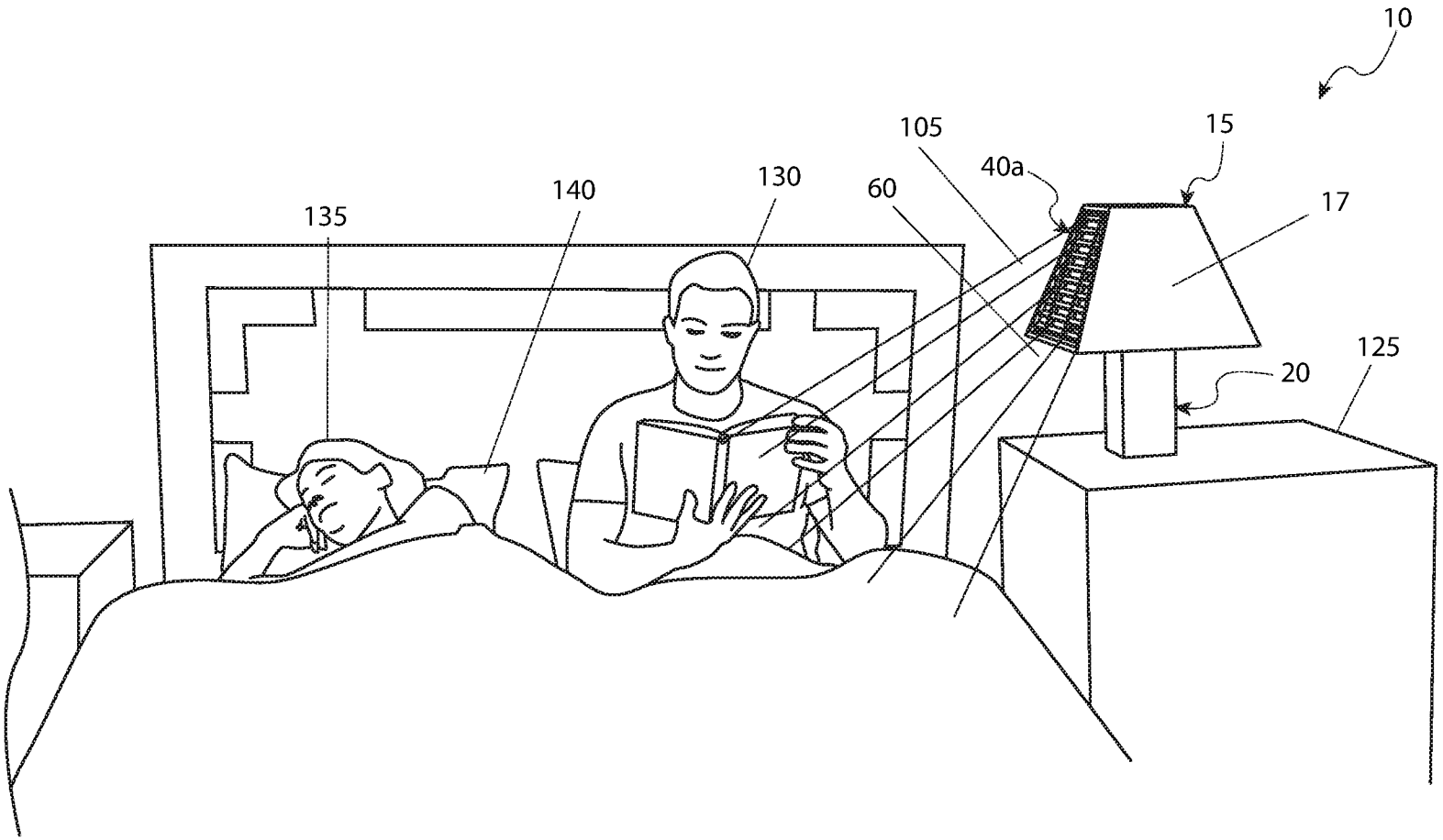
FIG. 5 is a perspective view of the adjustable light louver 10, shown in a utilized state, according to the preferred embodiment of the present invention.
Figure 6:
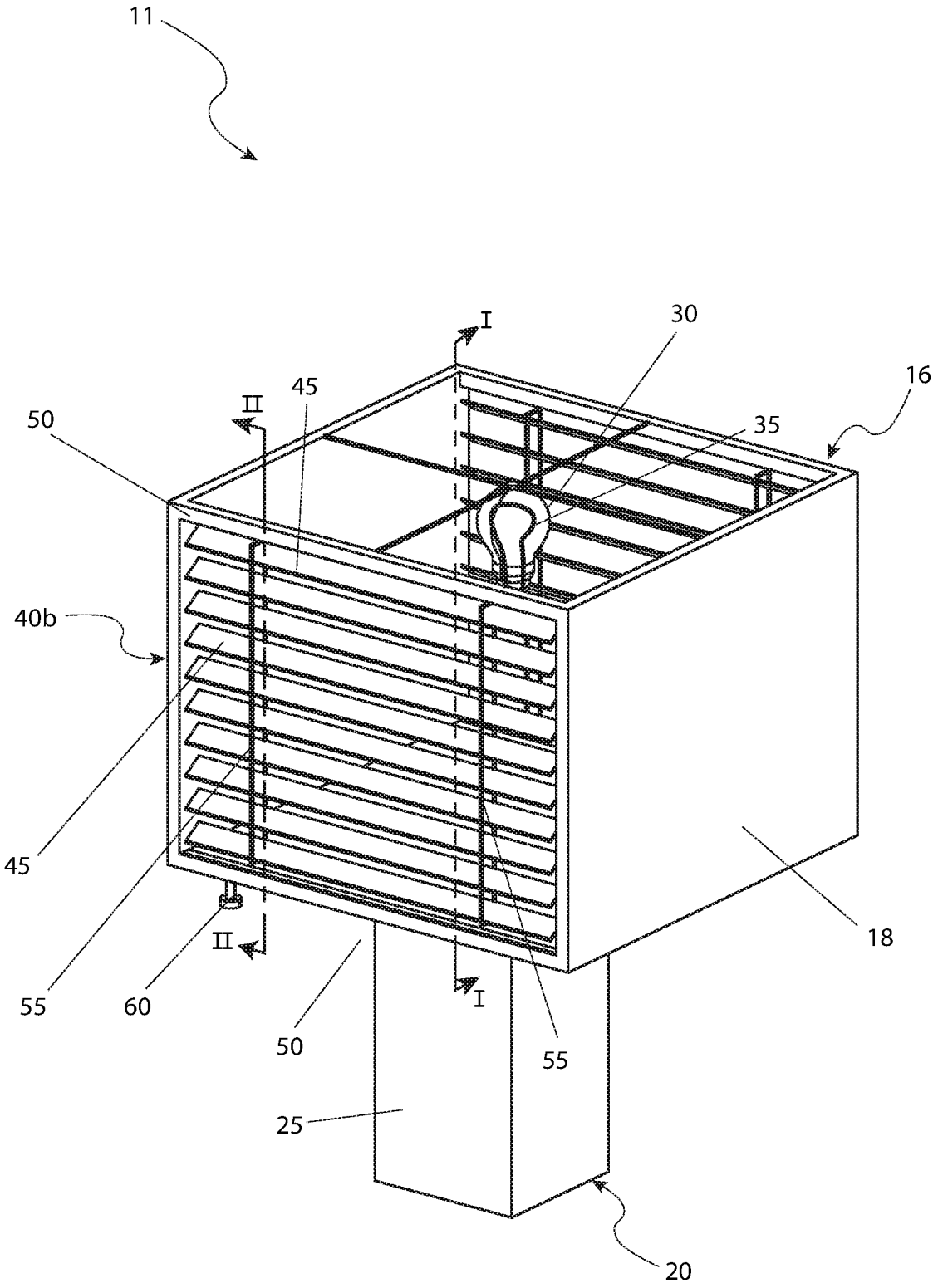
FIG. 6 is a perspective view of an alternate adjustable light louver 11, according to the preferred embodiment of the present invention.
Figure 7:
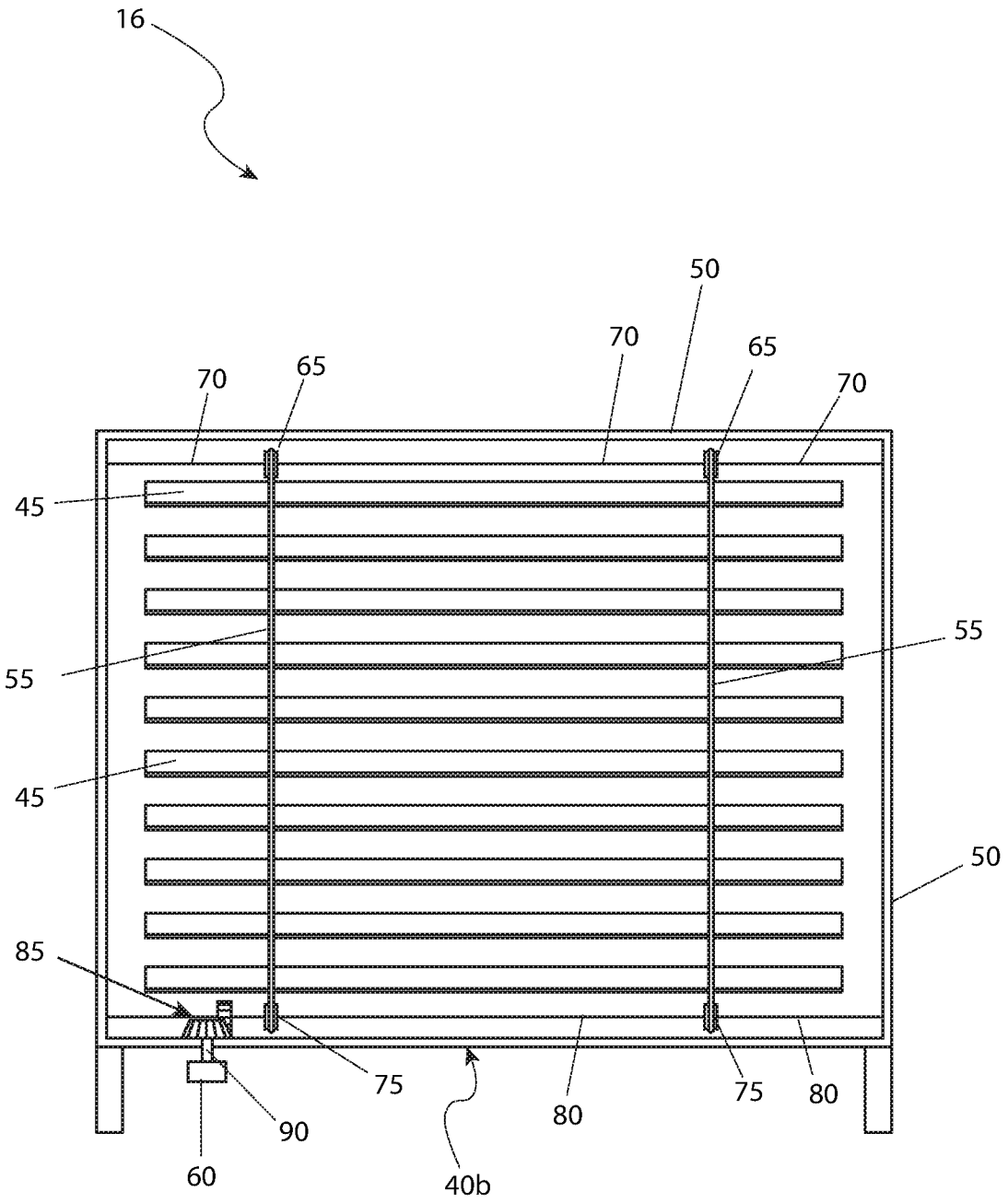
FIG. 7 is a sectional view of the alternate adjustable light louver 11, as seen along a line III-III, as shown in FIG. 6, according to the preferred embodiment of the present invention.
Figure 8:
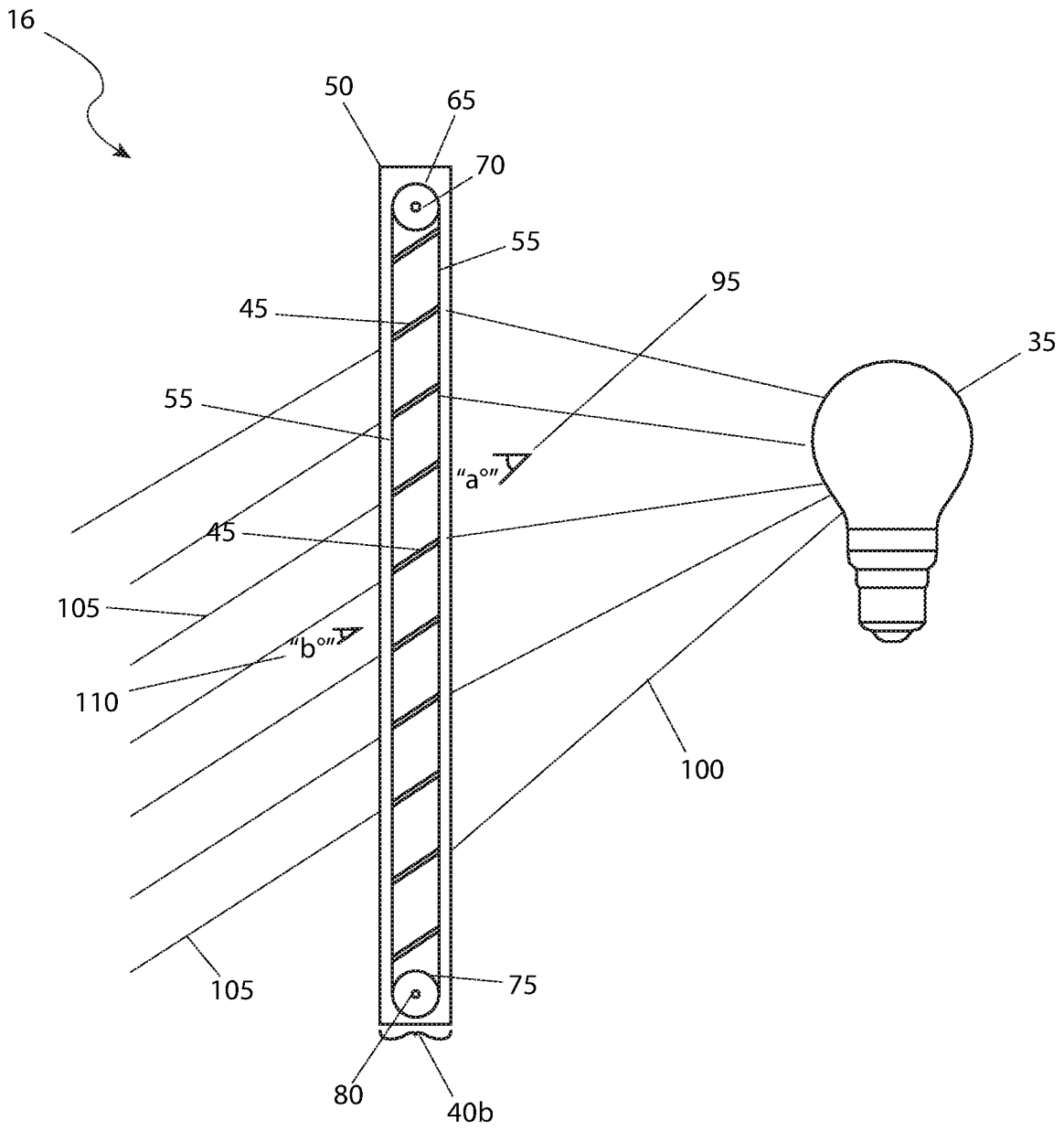
FIG. 8 is a sectional view of the alternate adjustable light louver 11, shown in a partially closed state, as seen along a line IV-IV, as shown in FIG. 6, according to the preferred embodiment of the present invention; and, FIG. 9 is a sectional view of the alternate adjustable light louver 11, shown in a mostly open state, as also seen along a line IV-IV, as shown in FIG. 6, according to the preferred embodiment of the present invention.

Referring to FIG. 5, a perspective view of the device 10, shown in a utilized state, according to the preferred embodiment of the present invention is depicted. A table lamp 20 with the device 10 installed is placed upon a bedside horizontal surface 125. A first user 130 who wishes to read is nearest the device 10, while a second user 135 who wishes to sleep is present in a bed 140. The first user 130 adjusts the slat angle adjustment knob 60 so that exiting light rays 105 only strike the first user 130 and a reading object 145, such as a book. In this manner, the second user 135 is not disturbed by direct light rays and can sleep. As aforementioned described, the device 10 could be located in between two (2) beds 140 with louvered surface 40*a* (as shown in FIG. 1) located on opposite sides. Should greater illumination be required, such as when getting dressed in the morning, the slat angle adjustment knob 60 can be adjusted to allow for a greater amount of exiting light rays 105 penetration.

FIGS. 6 through 9 illustrate an alternate embodiment of the device 11. Alternate versions of the device 11 could be provided with four (4) or more louvered surface 40*b* in cases of square, hexagonal, octagonal, or the like. In the illustrated example, the alternate shade assembly 16 is generally cuboid in shape. As in the preferred embodiment 10, the alternate shade assembly 16 incorporates louvered panels 40*b* on some exterior surfaces and alternate shade panels 18 on the remaining exterior surfaces. Either embodiment of the present invention can be utilized by the common user in a simple and effortless manner with little or no training. It is envisioned that the preferred adjustable light louver 10 would be constructed in general accordance within FIG. 1 through FIG. 4, or the alternate adjustable light louver 11 would be constructed in general accordance within FIG. 6 through FIG. 9.

After procurement of either embodiment of shade assembly 15, 16 with the necessary amount of louvered surface 40*a*, 40*b* installed as dictated by the needs of the space being illuminated, the shade assembly 15, 16 is installed upon a table lamp 20 using the supporting harp 30 and attachment hardware in a conventional manner. It is then placed upon an appropriated bedside horizontal surface 125. At this point in time, it is ready for utilization.

Figure 9:
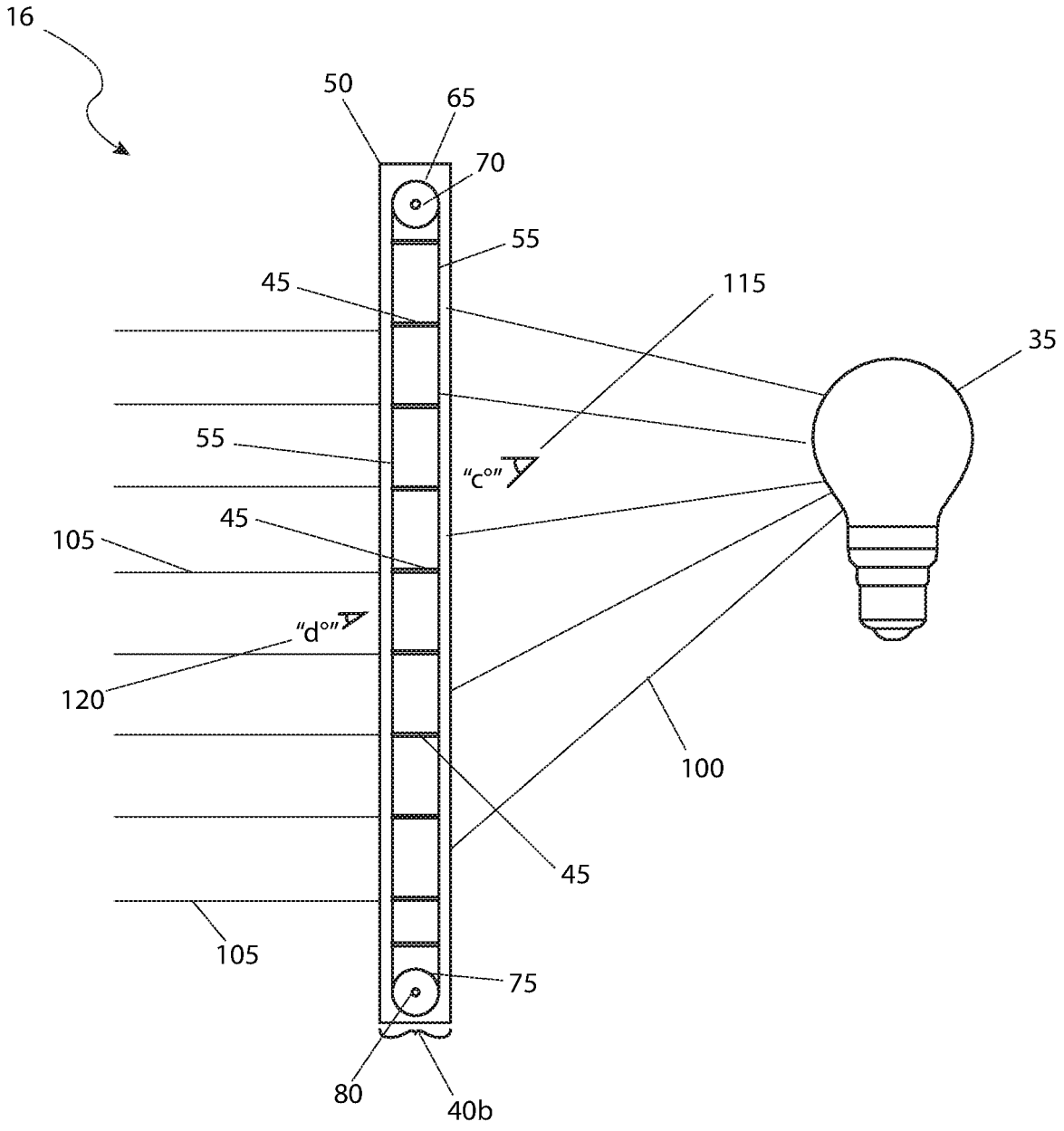

During periods of time when greater amount of direct illumination is required, the slats 45 are adjusted by the slat angle adjustment knob 60 as depicted in FIG. 4 or alternately in FIG. 9. When limited amount of direct illumination is needed, such as when reading in bed as depicted in FIG. 5, the slats 45 are adjusted by the slat angle adjustment knob 60 as depicted in FIG. 3, or alternately in FIG. 8. Such readjustment can occur as needed on a continual basis.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A lamp with an adjustable lamp shade comprising:

a shade assembly, comprising:

at least one louver assembly, each located on an individual side of said shade assembly and each comprising:

a frame;

a plurality of slats, each horizontally attached between opposing sides of said frame; and an actuating mechanism in rotatable communication with said plurality of slats; and at least one shade panel, each located on remaining sides of said shade assembly;

a base;

a harp, attached to an upper part of said base, said harp supporting said shade assembly thereon; and an illuminating device, attached to said base and capable of being in electrical communication with a power source;

wherein said plurality of slats are capable of freely rotating respective to said frame;

wherein rotation of said actuating mechanism in a first direction opens said plurality of slats; and wherein rotation of said actuating mechanism in a second direction closes said plurality of slats slats wherein said actuating mechanism further comprises an upper shaft located at an upper end of said frame, capable of freely rotating relative to said frame; a drive axle located at a bottom end of said frame, disposed parallel with said upper shaft, and having a first end capable of rotating freely within said frame; at least one coupling element attached to each of said plurality of slats, each coupling element having a first distal end attached to said upper shaft and a second distal end attached to and in mechanical communication with said drive axle; and an adjustment knob located adjacent a bottom of said frame and in mechanical communication with a second end of said drive axle; and wherein said plurality of slats are disposed between said upper shaft and said drive axle.

2. The lamp of claim 1, further comprising idler pulleys attaching said first distal end of each said coupling element to said upper shaft and said second distal end of each coupling element to said drive axle.

3. The lamp of claim 2, further comprising a ninety degree bevel gear assembly, having a first end in mechanical communication with said adjustment knob and a second end in mechanical communication with said drive axle.

4. The lamp of claim 2, wherein each coupling element is a braided ladder cord.

5. The lamp of claim 2, wherein distal ends of each of said plurality of slats are held within said frame.

6. The lamp of claim 2, wherein said frame is generally pyramidal in shape.

7. The lamp of claim 6, further comprising two louver assemblies located directly opposite each other.

8. The lamp of claim 2, wherein said frame is generally cuboid in shape.

9. The lamp of claim 8, further comprising two louver assemblies located directly opposite each other.

10. An adjustable lamp shade, comprising:

a shade assembly, comprising:

at least one louver assembly, each located on an individual side of said shade assembly and each comprising:

a frame;

a plurality of slats, each horizontally attached between opposing sides of said frame; and an actuating mechanism in rotatable communication with said plurality of slats; and at least one shade panel, each located on remaining sides of said shade assembly;

wherein said lamp shade is configured to be installed on a lamp having a base and an illuminating device capable of being in electrical communication with a power source;

wherein said plurality of slats are capable of freely rotating respective to said frame;

wherein rotation of said actuating mechanism in a first direction opens said plurality of slats; and, wherein rotation of said actuating mechanism in a second direction closes said plurality of slats wherein said actuating mechanism further comprises an upper shaft located at an upper end of said frame, capable of freely rotating relative to said frame; a drive axle located at a bottom end of said frame, disposed parallel with said upper shaft, and having a first end capable of rotating freely within said frame; at least one coupling element attached to each of said plurality of slats, each coupling element having a first distal end attached to said upper shaft and a second distal end attached to and in mechanical communication with said drive axle; and an adjustment knob located adjacent a bottom of said frame and in mechanical communication with a second end of said drive axle; and, wherein said plurality of slats are disposed between said upper shaft and said drive axle.

11. The lamp shade of claim 10, further comprising idler pulleys attaching said first distal end of each said coupling element to said upper shaft and said second distal end of each coupling element to said drive axle.

12. The lamp shade of claim 11, further comprising a ninety degree bevel gear assembly, having a first end in mechanical communication with said adjustment knob and a second end in mechanical communication with said drive axle.

13. The lamp shade of claim 11, wherein each coupling element is a braided ladder cord.

14. The lamp shade of claim 11, wherein distal ends of each of said plurality of slats are held within said frame.

15. The lamp shade of claim 11, wherein said frame is generally pyramidal in shape.

16. The lamp shade of claim 15, further comprising two louver assemblies located directly opposite each other.

17. The lamp shade of claim 11, wherein said frame is generally cuboid in shape.

18. The lamp shade of claim 17, further comprising two louver assemblies located directly opposite each other.

* * * * *